United States Patent [19]

Sartor

[11] Patent Number: 4,592,567

[45] Date of Patent: Jun. 3, 1986

[54] MODIFIABLE STIFFNESS SKI

[75] Inventor: Leo Sartor, Caerano, Italy

[73] Assignee: Caber Italia S.p.A., Montebelluna, Italy

[21] Appl. No.: 540,960

[22] Filed: Oct. 11, 1983

[30] Foreign Application Priority Data

Oct. 19, 1982 [IT] Italy ..... 41656 A/82

[51] Int. Cl.[4] ..... A63C 5/07

[52] U.S. Cl. ..... 280/602; 280/809

[58] Field of Search ..... 280/602, 607, 618, 620, 280/603, 809

[56] References Cited

U.S. PATENT DOCUMENTS

| | | | |
|---|---|---|---|
| 2,258,046 | 10/1941 | Clement | 280/602 |
| 3,300,226 | 1/1967 | Reed | 280/602 |
| 4,300,786 | 11/1981 | Alley | 280/602 |

*Primary Examiner*—David M. Mitchell

*Assistant Examiner*—Everett G. Diederiks, Jr.

[57] ABSTRACT

The ski comprises a basic self-supporting ski structure, the front and rear portions whereof are provided with mounts made rigid therewith and retaining at least a replaceable small thickness rectangular batten or insert mechanically affecting the flexure and torsional characteristics of the ski in such a way as to cause the ski stiffness to be varied.

3 Claims, 4 Drawing Figures

MODIFIABLE STIFFNESS SKI

BACKGROUND OF THE INVENTION

This invention relates to a ski the stiffness characteristics whereof may be varied.

It is known that, depending on the skiing discipline practiced, one must select ski having certain characteristics.

Also known is that the ski characteristics must be different, depending on whether the athlete is involved in a skiing event, or for example, in skiing for training purposes or just the fun of it.

The snow characteristics also would require the availability of an implement each time different.

Heretofore, the problem has been solved by using different skis to meet changing situations.

A complete skier, who intends to practice a number of specialties, shoud, therefore, have various ski types available, thus facing considerable expense and still without fully solving the problem at that.

SUMMARY OF THE INVENTION

It is an object of this invention to provide a ski whose performance characteristics may be modified to meet the requirements of individual specialties or of an intended trail.

Another object is to provide a ski, whose characteristic elasticity, flexure, and torsion can be changed.

A further object is to provide a ski, whose characteristics can be changed in a simple and inexpensive fashion.

Still another object of the invention is to provide a ski, whereby the characteristic modification can be effected directly by the athlete through simple elements which are combined with the main structure, without resorting to tools or equipment.

Yet another object is to provide a ski which is functional and economical.

According to one aspect of the invention these and other objects, such as will be apparent hereinafter, are achieved by a ski with modifiable stiffness characteristics, comprising a basic ski structure, characterized in that the basic ski structure comprises connection means rigid therewith and stiffening inserts removably retained by said connection means. More particularly, the front and rear portions of the basic ski structure are provided with mounts rigid with said structure, said mounts being selectively spaced apart and retaining at least one replaceable batten, effective to mechanically affect the flexure and torsional characteristics of said ski in such a way as to change such characteristics depending on the characteristics of said batten.

BRIEF DESCRIPTION OF THE DRAWINGS

Further features and advantages of the invention will be more apparent from the following detailed description of preferred embodiments thereof, given herein by way of example and not of limitation with reference to the accompanying drawings, where.

DESCRIPTION OF THE PREFERRED EMBODIMENTS

Figure 1:
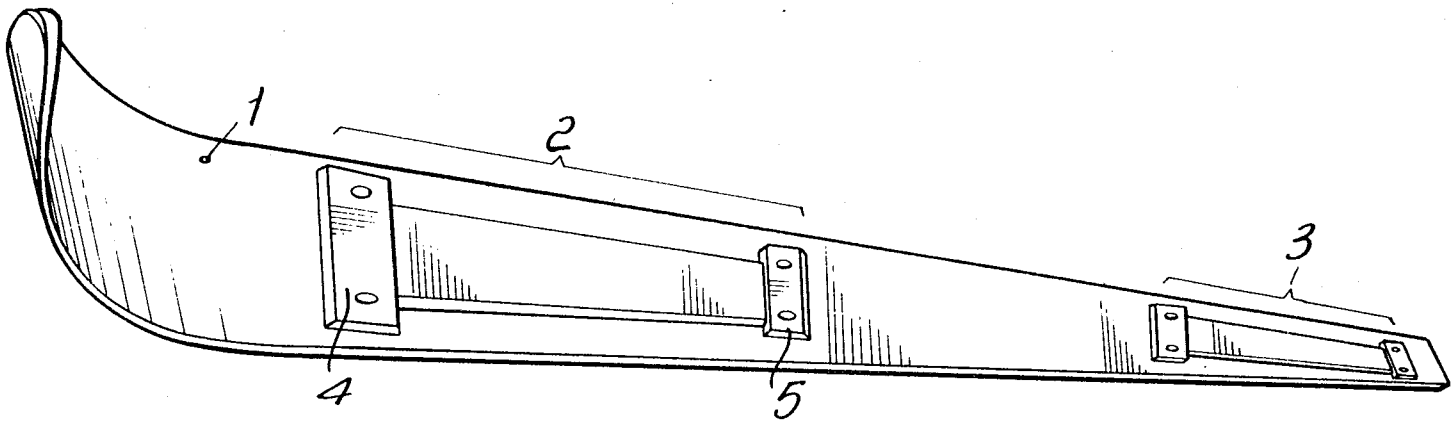
FIG. 1 shows a ski according to the invention to illustrate the batten positioning and arangement.
Figure 2:
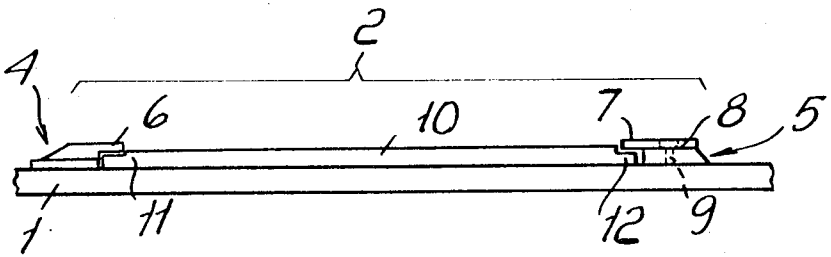
FIG. 2 is a longitudinal section view of the ski shown in FIG. 1, taken through an associated batten.

With reference to the drawing figures, on a ski generally indicated at 1 in FIG. 1, there are provided two areas, a front area 2 and rear area 3, whereat the implement flexure can be modified.

The areas 2 and 3 are provided with essentially equivalent devices, so that one of them only will be discussed herein, namely that included in the front area 2.

According to the invention, two mounts are attached to the ski 1, respectively a front one 4 and rear one 5, which comprises two threaded-in blocks or blocks in any way firmly fastened to the ski structure.

The front mount 4 has, on its portion facing the rear mount 5, a recess 6 which defines essentially a pocket extending parallel to the top face of the ski 1.

The rear mount 5 has a seat or pocket 7, similar to recess or pocket 6 of the front mount 4 but comprised, however, of a removable element 8 associated by screws 9 with the ski 1 which enable the element 8 to be removed and the pocket 7 opened.

A batten 10 has its front 11 and rear 12 ends configured to fit tightly in the seats 6 and 7.

Once inserted, the batten 10, being made rigid with the ski ends, contributes to the flexing properties of the ski.

The batten 10 may be conveniently formed from such materials as glass fiber, carbon fiber, light metals, or the like and, by suitably selecting its thickness or width, the extent of the batten contribution to the characteristic flex and torsion of the ski may be determined.

Figure 3:
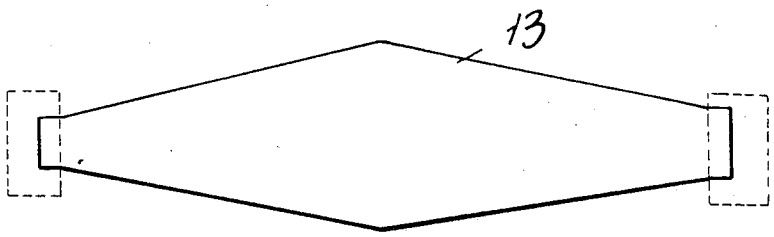
FIG. 3 shows a batten with a modified configuration from that shown in FIG. 1.

FIG. 3 shows another embodiment of the batten, indicated at 13 and configured lozenge-like.

With such a configuration, i.e. with a non-constant width dimension, one can further control the torsional characteristics of the ski front portion or rear portion.

Figure 4:
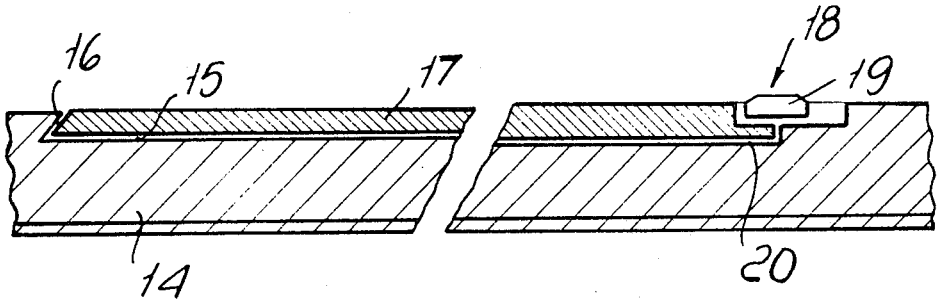
FIG. 4 illustrates a possible way of associating the batten to the ski.

In an alternative embodiment form shown in FIG. 4, formed in the ski structure, presently indicated at 14, is a depressed seat 15 having a sloping front rabbet 16, wherein the batten is inserted, as presently indicated at 17.

On the rear, the mount indicated at 18 comprises a slider element 19 which enables the rear portion 20 of the batten 17 to be locked such that it cannot slide out of the seat 15.

The length of the batten 17 is also in this case such that it can contact the front and rear walls of the seat 15.

That embodiment affords an improved appearance over that shown in FIG. 1.

It may be appreciated from the foregoing how, while having available a self-supporting ski structure such as those indicated at 1 or 14 in the drawings, by adding battens of different materials or configurations, one can achieve different characteristic flexures or torsions for the ski.

This allows the utilization of one basic ski structure for any specialties by merely replacing, without any difficulties, the batten elements which affect the performance characteristics of the ski.

Based upon the same inventive concept, the invention may be given many different configurations.

More specifically, the mounts or means for connecting the battens with the ski structure may be of any desired types, on condition that they are effective to lock the batten two heads to the ski structure.

It should be further noted that the batten, in the no-load condition of the ski, imposes no further stress on the ski structure.

This is specially convenient, since the ski may be of the same general type as those utilized heretofore.

An appropriate selection of the materials and dimensions for the battens would afford a very wide range of ski performance, thus making it, as mentioned, suitable for any applications.

The materials and dimensions may be selected as desired without departing from the protection scope of the instant patent.

I claim:

1. A ski with modifiable stiffness characteristics comprising a basic ski structure, a first front block attached to a front portion of said basic ski structure, a first rear block attached to said front portion of said basic ski structure, said first front block and said first rear block being superimposed on said front portion of said basic ski structure and selectively spaced apart, said ski with modifiable stiffness characteristics further comprising a second front block attached to a rear portion of said basic ski structure, a second rear block being attached to said rear portion of said basic ski structure, said second front block and said second rear block being superimposed on said rear portion of said basic ski structure and lying coaxial with respect to said first front block and said first rear block, said basic ski structure having a longitudinal mid axis, all of said blocks lying over said longitudinal mid axis, one of the first and second front blocks and one of the first and second rear blocks having rigidly associated therewith a protuberance extending parallel with respect to said basic ski structure and facing a corresponding block, another one of said first and second front blocks and another one of said first and second rear blocks having removably associated therewith a removable element, a recess defined between said basic ski structure and each protuberance and between said basic ski structure and each removable element, each recess defining a height dimension, a first replaceable batten having at least one end, at least another end, engaging with said first front block and said first rear block respectively, a second replaceable batten having at least one extremity and at least another extremity, engaging with said second front block and said second rear block respectively, said first and second replaceable battens being adapted to be replaced by battens selected among stiffer or more flexible battens to be put in their place, said battens having at each of said ends and extremities thereof a tongue, each tongue defining a thickness dimension correpsonding to said height dimension defined by said recess to enable said battens to fit tightly in said first front block and in said first rear block and in said second front block and said second rear block respectively, said first rear block and said second front block being spaced apart for accommodating therebetween a ski boot placed on said basic ski structure.

2. A ski with modifiable stiffness characteristics according to claim 1 wherein said first replaceable batten and said second replaceable batten each define a non-constant cross section lozenge shape having a central width dimension and defining at each of said ends and extremities thereof a batten thickness dimension and an end width dimension, said central width dimension being greater than said end width dimension, said batten thickness dimension corresponding to said height dimension defined by said each recess.

3. A ski with modifiable stiffness characteristics comprising a basic ski structure, a first front block attached to a front portion of said ski structure, a first rear block attached to said front portion of said basic ski structure, said first front block and said first rear block being superimposed on said front portion of said basic ski structure and selectively spaced apart, said ski with modifiable stiffness characteristics further comprising a second front block attached to a rear portion of said basic ski structure, a second rear block being attached to said rear portion of said basic ski structure, said second front block and said second rear block being superimposed on said rear portion of said basic ski structure and lying coaxial with respect to said first front block and said first rear block, said basic ski structure having a longitudinal mid axis, all of said blocks lying over said longitudinal mid axis, one of the first and second front blocks and one of the first and second rear blocks having rigidly associated therewith a protuberance extending parallel with respect to said basic ski structure and facing a corresponding block, another one of said first and second front blocks and another one of said first and second rear blocks having removably associated therewith a removable element, a recess defined between said basic ski structure and each protuberance and between said basic ski structure and each removable element, each recess defining a height dimension, a first replaceable batten having at least one end, at least another end, engaging with said first front block and said first rear block respectively, a second replaceable batten having at least one extremity and at least another extremity engaging with said second front block and said second rear block respectively, said first and second replaceable battens being adapted to be replaced by battens selected among stiffer or more flexible battens to be put in their place, said battens having at each of said ends and extremities thereof a tongue, each tongue defining a thickness dimension corresponding to said height dimension defined by said recess to enable said battens to fit tightly in said first front block and in said first rear block and in said first front block and said second rear block respectively, said first rear block and said second front block being spaced apart for accommodating therebetween a ski boot placed on said basic ski structure, said replaceable battens each defining a non-constant cross section lozenge shape having a central width dimension and defining at said ends thereof a batten thickness dimension and an end width dimension, said central width dimension being greater than said end width dimension, said batten thickness dimension corresponding to said height dimension defined by said each recess.

* * * * *